US006313198B1

(12) United States Patent
Ho et al.

(10) Patent No.: US 6,313,198 B1
(45) Date of Patent: Nov. 6, 2001

(54) EMULSION FEED ASSEMBLY AND METHOD

(75) Inventors: Bosco P. Ho; Lawrence J. Mahr, both of Pittsburgh, PA (US)

(73) Assignee: Calgon Corporation, Pittsburgh, PA (US)

( * ) Notice: Subject to any disclaimer, the term of this patent is extended or adjusted under 35 U.S.C. 154(b) by 0 days.

(21) Appl. No.: 09/414,185

(22) Filed: Oct. 7, 1999

Related U.S. Application Data

(62) Division of application No. 08/970,471, filed on Nov. 14, 1997, now Pat. No. 6,004,024.

(51) Int. Cl.[7] ..... B01F 15/02

(52) U.S. Cl. ..... 523/315; 523/313; 523/318; 523/319; 523/324; 523/333; 523/334; 366/167.1; 366/191; 366/138

(58) Field of Search ..... 523/313, 315, 523/318, 319, 324, 333, 334; 366/167.1, 138, 191

(56) References Cited

U.S. PATENT DOCUMENTS

| | | | |
|---|---|---|---|
| 3,547,409 | 12/1970 | Jacuzzi | 366/167.1 |
| 4,051,065 | 9/1977 | Venema . | |
| 4,224,156 | 9/1980 | Pardikes et al. . | |
| 4,279,759 | 7/1981 | Pardikes . | |
| 4,409,364 | 10/1983 | Schmukler et al. . | |
| 4,419,408 | 12/1983 | Schmukler et al. . | |
| 4,452,942 | 6/1984 | Shida et al. . | |
| 4,460,632 | 7/1984 | Adur et al. . | |
| 4,460,745 | 7/1984 | Adur et al. . | |
| 4,471,887 | 9/1984 | Decker | 366/162.5 |
| 4,481,262 | 11/1984 | Shida et al. . | |
| 4,499,198 | 2/1985 | Pullukat et al. . | |
| 4,530,913 | 7/1985 | Pullukat et al. . | |
| 4,545,925 | 10/1985 | Bosen et al. . | |
| 4,561,920 | 12/1985 | Foster . | |
| 4,575,532 | 3/1986 | Schmukler et al. . | |
| 4,578,440 | 3/1986 | Pullukat et al. . | |
| 4,590,246 | 5/1986 | Dombro et al. . | |
| 4,600,746 | 7/1986 | Schmukler et al. . | |
| 4,632,801 | 12/1986 | Dowd . | |
| 4,634,744 | 1/1987 | Hwang et al. . | |
| 4,675,471 | 6/1987 | Shida et al. . | |
| 4,778,820 | 10/1988 | Minnick . | |
| 4,834,545 | 5/1989 | Inoue et al. | 366/138 |
| 5,018,870 | 5/1991 | Brazelton et al. . | |
| 5,018,871 | 5/1991 | Brazelton et al. . | |
| 5,135,968 | 8/1992 | Brazelton et al. . | |
| 5,164,429 | 11/1992 | Brazelton et al. . | |
| 5,252,635 | 10/1993 | Brazelton et al. . | |
| 5,284,626 | 2/1994 | Brazelton et al. . | |
| 5,284,627 | 2/1994 | Brazelton et al. . | |
| 5,316,031 | 5/1994 | Brazelton et al. . | |
| 5,323,017 | 6/1994 | Pardikes . | |
| 5,344,619 | 9/1994 | Larwick et al. | 366/167.1 |
| 5,372,421 | 12/1994 | Pardikes . | |
| 5,403,552 | 4/1995 | Pardikes . | |
| 5,407,975 | 4/1995 | Pardikes . | |
| 5,470,150 | 11/1995 | Pardikes . | |
| 5,823,670 | 10/1998 | Rushing et al. | 366/152.1 |

FOREIGN PATENT DOCUMENTS

| | | | |
|---|---|---|---|
| 229875 | 7/1987 | (EP) | 366/167.1 |
| 2107325 A | 4/1983 | (GB) . | |
| 2113696 A | 8/1983 | (GB) . | |
| 2192806 A | 1/1988 | (GB) . | |
| 4341336 | 11/1992 | (JP) | 366/138 |

*Primary Examiner*—Peter Szekely
(74) *Attorney, Agent, or Firm*—Reed Smith LLP

(57) ABSTRACT

The present invention is directed to a polymer feed system and a method of using the same wherein clogging of the polymer input line is avoided by the use of air to purge the system of any unwanted polymer or electrolyte. The purging avoids the contact of the water with the polymer and the build-up of unwanted activated polymer and clogging in the supply and in the subsequent conduits.

10 Claims, 3 Drawing Sheets

EMULSION FEED ASSEMBLY AND METHOD

This application is a divisional application of Ser. No. 08/970,471, filed Nov. 14, 1997, now U.S. Pat. No. 6,004,024.

BACKGROUND OF THE INVENTION

1. Field of the Invention

The present invention is directed to a polymer feed assembly or polymer activation system for feeding polymer (dry, liquid, or emulsified) to a mixing chamber and mixing the polymer with a predetermined amount of an electrolyte to activate the polymer. The present invention is specifically designed to avoid premature activation of the polymer along the polymer supply line or at the polymer/water contact site, as well as at any subsequent conduits to avoid clogging or bridging of the polymer input line at these sites. The present invention includes a purging mechanism whereby unwanted moisture or polymer is removed from the polymer feed assembly in order to avoid or prevent clogging.

2. Background and Description of the Related Art

Polymers activated through a polymer feed assembly may be used in a variety of applications, including: water purification and flocculation; automotive paint spray booths: in the chemical industry to separate inorganics and solids from effluent, in the coal industry to promote solids settling and to float coal fines; in the petro-chemical industry to enhance oil recovery; in the phosphate industry to improve recovery; in the pulp and paper industry as dewatering aids and retention aids; or in the steel industry to settle waste. This list is by no means all inclusive. An example of a polymer that is typically used in these industries is polyacrylamide. Another example is a copolymer of acrylamide with an anionic molecule such as acrylic acid. The polymers, whether in dry, liquid or emulsion form, are ionic-charged organic molecules which are soluble in an electrolytic fluid such as water. The terms electrolytic fluid, solvent, and water will be referred to interchangeably herein, but retain their respective definitions where specifically noted.

Usually polymers utilized in these applications are manufactured and shipped in a deactivated form to a location where they will be utilized. At that location, it is necessary to activate the polymers before they can be used for their intended purpose. U.S. Pat. Nos. 5,407,975 and 5,470,150, both of which are hereby incorporated herein by reference, are examples of polymer activating systems known in the art.

For a dry polymer, initial activation requires more energy and time because there is no water present. In addition, the energy required for activation increases with increasing particle size. Liquid polymers are defined as polymers already dissolved to some extent in water. Although activation is easier for liquid polymers than dry polymer, the viscous nature of the liquid polymer makes handling (e.g. pumping) of the liquid polymer difficult. Polymers in emulsion form have a relatively low viscosity when compared to liquid polymers, and therefore are easier to handle. Emulsified polymers also activate easier than dry polymers because of the small size of polymer particles. Another advantage of emulsified polymers is that they provide higher polymer concentration than liquid form.

Emulsified polymers have numerous advantages over other unactivated polymer forms. An emulsion polymer normally consists of polymer, either in dry form or liquid form in an inactive state, encased in an oil phase. The hydrocarbon surroundings of the inactive polymer must be broken down to allow water to contact the polymer in order to activate and invert the polymer. Further activation is required to allow further hydration (e.g. the penetration of more water), as well as the uncoiling of the molecule. Once the molecules begin to repel each other, the polymer molecule straightens and changes from a substantial coil shape into a long and substantially straight conformation. Once the molecules begin to repel each other, the polymer is considered to be in activated form.

Once activated, the polymer molecules can perform their intended function. An example of such a function is flocculation. Inadequate activation may result in loss of efficiency in the intended use of the polymer. In addition, the activation process must be designed precisely so as to successfully change the original state of the concentrated emulsified polymer into a diluted activated form at a predetermined concentration. Poor activation results in a polymer which is inefficient and may result a material consistency that is difficult for purposes of material handling (i.e. a more viscous material), and may result in a polymer that cannot be further activated, and may result in clogging or bridging in the system.

The related art generally uses either batch or continuous feeding methods to activate emulsified polymers. In both batch and continuous methods, polymer and water are delivered to a polymer/water contact site where they may be activated. The polymer/water contact site is usually part of a mixing chamber. The mixing chamber can be of any dimension or form as long as it brings the emulsified polymer and water together. An eductor is an example of a mixing chamber where stored energy in the water in the form of pressure is released and imparted to the molecules of water and polymer entering into the eductor. A static mixer is another example of a mixing chamber. Activation continues in the mixing chamber and subsequent conduits. In a batch system, the polymer is further activated by aging in a tank where the partially activated polymer is mixed with an impeller or mixed by recirculation or alternatively simply left standing. In a continuous system, the polymer is further activated by: introducing a significantly larger volume of solution into the system with or without the use of static shearing devices (generally known as static mixers); imparting energy via recirculation of part of the system through a pump, or a mixer, or any moving or static shearing devices, or imparting energy by passing through (once-through without recirculation) a contained volume with a mixer or any moving or static shearing device. The mixing chamber can be either inside or outside the recirculating system or the contained volume described above.

One of the major problems of the related art is the occurrence of clogging or bridging of polymer within the polymer supply line or near the point where the polymer supply line enters the mixing chamber (this may be referred to herein as the polymer/water contact site) or at subsequent conduits. Unwanted activation of the emulsified polymer is caused by moisture entering into the polymer supply line and is exacerbated by a general funnel shape of the polymer supply line at or near the point where the polymer enters the mixing chamber. The funnel shape often results from an attempt to minimize the backflow of water by minimizing, the area of contact between polymer and water at the polymer/water contact site. Also, due to the viscosity of the polymer, the cross sectional area of the polymer supply line is generally larger than the cross sectional area of the polymer/water contact site. This results in a funneling of the polymer supply line at or near the input port of the mixing chamber. Although the funneling is intended to minimize unwanted activation, once activated, the funneling area is clogged with partially activated polymer.

Clogging of the polymers supply line is the result of unwanted or pre-mature activation of an emulsified polymer anywhere in the polymer supply line other than the polymer/water contact site or mixing chamber.

Clogging in the mixing chamber and subsequent conduits (i.e., recirculation or dispensing conduits) is usually caused by: the propagation of the prior clogging from the polymer supply line; the loss of activation energy (mixing energy) in the mixing chamber and subsequent areas; or the loss of adequate quantity of water in these areas. Loss of imparted energy and loss of water supply are often the result of natural unpredictable malfunction of equipment.

Unwanted activation often results firm inherent characteristics of the polymer or operational methodology of the activation system. Known factors that intensify unwanted activation are: higher concentration of active polymer in the emulsified polymer; higher molecular weight (larger molecules) of the polymer; polymer material that has a higher affinity for water (hydrophilic); and periodic shutdowns of the assembly. Down times for the emulsion feed assembly are particularly bad for clogging purposes because the emulsified polymer is no longer in motion.

Unwanted or pre-mature activation is also an inherent property of the polymer due to the abundant presence of water or moisture. As mentioned above, precise design features are required to prevent this unwanted contact of the emulsified polymer with water other than at the polymer/water contact site or in the mixing chamber. Examples of such preventative designs include a valve inserted between the polymer supply line and the polymer/water contact site and a funnel-shaped conduit. In the related art funnel-shape at the end of the polymer input line minimizes backflow because the area of contact at the polymer/water contact site is minimized.

Regardless of how precise the design is, small amounts of water or moisture may start the propagation or unwanted activation of the emulsified polymer. Unwanted activation results in a very viscous material which begins to partially clog the polymer supply line and valves. With time, the quantity of viscous material increases, often resulting in unscheduled down time for repair and cleaning of the feed assembly.

SUMMARY OF THE PRESENT INVENTION

The present invention provides a new and improved means for, and method of, activating emulsified polymers which avoids unwanted activation of the polymer which prevents premature activation of an emulsified polymer in, or around, the polymer input line, and which clogging or bridging in the polymer input line, and clogging or bridging of the polymer input line at the polymer/water contact site, or in conduits in communication therewith.

The present invention also utilizes pressurized air to purge the system of any unwanted, partially activated, or fully activated polymer as well as any moisture that may activate the polymer. Purging removes any build-up of unwanted activated polymer in the polymer supply line and prevents further clogging in the supply line and in subsequent conduits. Alternatively, a vacuum may be used and placed in communication with the mixing chamber and the supply lines to remove any excess moisture or presence of electrolyte which may cause unwanted polymer activation. precipitation, bridging or clogging.

The present invention is directed to an polymer feed system, more specifically an emulsion feed system which comprises a polymer supply line for supplying polymer to a mixing chamber, an electrolyte supply line for supplying electrolyte to the mixing chamber, and an air supply line. The air supply line functions as a conduit for supplying either pressurized air or a vacuum to remove any unwanted precipitated polymer, excess moisture, or polymerized matter (activated polymer) in the mixing chamber and conduits or supply lines attached thereto. The emulsion feed system may include a valve assembly which is interposed between the polymer supply line and the mixing chamber which, when open, allows fluid communication the supply line and the mixing chamber. The valve assembly or the polymer supply line preferably extends through an input port of the mixing chamber into the space defined by the mixing chamber. In this space, the valve assembly or the polymer supply line may be cleaned by the flow of water or electrolyte in the mixing chamber. In the preferred embodiment, the valve assembly and the supply line are of a substantially uniform diameter extending from the polymer supply source into the mixing chamber. A substantially uniform diameter conduit means a conduit which has a substantially equivalent cross-sectional area or diameter along its length and excludes a frosticonical shape near the point where the supply line and any moisture from the mixing chamber may be in contact. The cross-sectional area of the polymer supply line and the input port of the mixing chamber will, of course, depend on the viscosity of the emulsified polymer being used and the electrolyte system being used.

The air supply line may be utilized to increase the air pressure to purge or blow out any excess polymer or precipitated material in the polymer supply line or alternatively may be used to create a vacuum to remove any excess moisture or unwanted polymer.

The embodiments of the emulsion feed system of the present invention also provides controls for varying the concentration of the polymer and/or a secondary fluid delivery system which may be used dilute the concentrated polymer after it is inverted.

Another embodiment of the present invention is directed to a method of mixing a polymer with an electrolyte which includes injecting a flow of an electrolyte into a mixing chamber and injecting a polymer into the flow of electrolyte via an input port of said mixing chamber. The method further comprises mixing the polymer with the flow of electrolytes to obtain a predetermined concentration of a polymer/electrolyte mixture. In this embodiment, the utilization of substantially similar diameter polymer supply lines and input ports reduces the problems of bridging or clogging present when the polymer supply line includes a frosticonical or funnel shape and allows continuous and even flow of the polymer. After mixing, the polymer electrolyte mixture is dispensed from the mixing chamber to a desired output source. The method includes the step of purging the system with pressurized air to remove any excess polymer electrolyte mixture present in the mixing chamber or which may have precipitated in the input port or supply line of the polymer. Alternatively or in combination with the pressurized air, the method may include the step of creating a vacuum to remove any excess moisture or unwanted polymer/electrolyte mixture that may be present in the mixing chamber and/or the polymer supply line.

Although not necessary, it is a preferred aspect of the present invention to maintain a substantially uniform diameter in the conduit extending from the emulsified polymer source to the mixing chamber. A valve assembly may be inserted between the polymer supply line and the input port. If a valve assembly is used, when the valve is open, the diameter of the valve preferably has substantially the same diameter of both the polymer supply line and the input port of the mixing chamber. Either the valve assembly or the polymer supply line may threadingly engage the input port or may be inserted through a fitting which engages the input port. When inserted through a fitting the polymer supply may have a smaller internal diameter than the input port of the mixing chamber. The polymer feed system is designed so the polymer supply line or the conduit extending through the valve assembly extends through the input port and into the space defined by mixing chamber whereby the end portion thereof may be in contact with the flow of electrolyte. Contact with electrolyte permits any excess polymer at the tip of the valve assembly or polymer supply line to be washed off by the flow of electrolyte across the tip of the polymer supply line.

Another method of the present invention is comprised of activating emulsified polymer by injecting a stream of water into a mixing chamber, injecting an emulsified polymer into the stream of water to initiate activation of the emulsified polymer, dispensing the activated polymer to a desired destination, and, causing the mixing chamber and/or polymer supply line to be cleaned or purged of any excess polymer or electrolyte by injecting pressurized air into and through the mixing chamber and the polymer supply lines. In this embodiment, it is not required that the polymer supply line or valve assembly have a substantially equivalent cross-sectional areas as the input port of the mixing chamber because the sudden pressure differential may be utilized to avoid and rectify clogging, jelling or precipitation of activated polymer.

BRIEF DESCRIPTION OF THE DRAWINGS

Preferred embodiments of the invention are shown in the attached drawings wherein.

DESCRIPTION OF THE PREFERRED EMBODIMENTS

Although the invention has been described in terms of particular embodiments and with regard to particular applications, one of ordinary skill in the art, in light of this teaching, can generate additional embodiments and modifications without departing from the spirit of, or exceeding the scope of the claimed invention. Accordingly it is to be understood that the drawings and the descriptions herein are proffered by way of example only to facilitate comprehension of the invention and should not be construed to limit the scope thereof.

Figure 1:
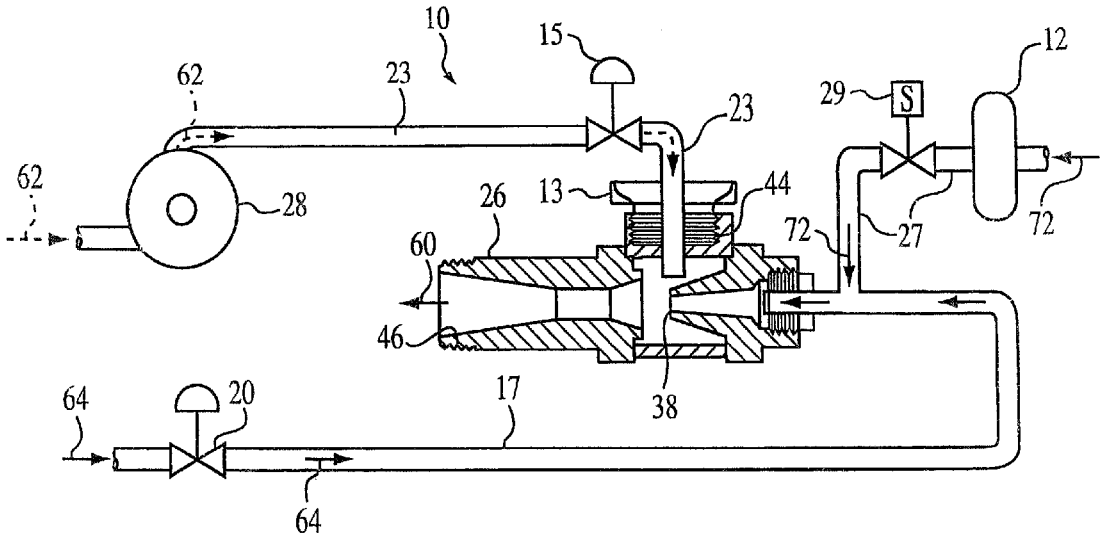
FIG. 1 is a cross-sectional view of one embodiment of the present invention with an eductor as a mixing chamber.

In FIG. 1, an embodiment of the polymer feed assembly or polymer activation system 10 is illustrated. Polymer feed assembly 10 more particularly emulsion feed assembly 10 utilized for polymer activation includes: a mixing chamber or eductor 26, a regulating valve 20 to deliver a pre-determined amount of water or electrolyte 64 from a water source (not shown) through water inlet line 17, a polymer pump 28 to deliver a pre-determined amount of an emulsified polymer 62 through the polymer input line 23 into the mixing chamber 26. Eductor 26 is intended to be the initial polymer/water contact site for initial activation of the emulsified polymer. To prevent unwanted activation and to prevent clogging, the present invention uses an air purge system 12 which is adjustable for example via solenoid valve 29. When valve 29 is open, air purge system 12 is in fluid communication with eductor 26 and any conduits which are in communication therewith. Air purge system 12 is preferably comprised of a source of pressurized air 72 (not shown), air inlet line 27, and valve assembly 29.

Pressurized air 72 is fed from air purge system 12 through air inlet line 27, through air control valve 29 which adjustably controls the air entering into eductor 26 and conduits in communication therewith. Air 72 then enters the emulsion feed assembly via air inlet line 27. The minimum essential requirements of air purge system 12 is a pressurized air supply source connected to emulsion feed assembly 10 to blow out any unwanted water or emulsified polymer that may be in emulsion feed assembly 10. Pressurized air 72 is turned on via valve 29 periodically to purge the system of any unwanted unactivated, partially activated, or fully activated polymer and any water, electrolyte or moisture that potentially can come in contact with the polymer 62. The primary purpose of the purge cycle is to clean the polymer/water contact site, although the purging also functions to clean other areas of accumulation that may be present in subsequent conduits (i.e., water inlet line 17, polymer input line 23, air inlet line 27). For systems where the polymer feed system 10 is idle, purging avoids potential contact of water moisture with the polymer and thus stops unwanted activation of the emulsified polymer and resulting settling in the polymer supply line.

The duration of air purging is preferably in a range of 1–120 seconds, more preferably in the range of 60 seconds and most preferably around 30 seconds. The time period between purges is adjustable depending on the viscosity, size, and activity of the emulsified polymer 62 or activated polymer 60 and depends on how quickly unwanted activation occurs. Typically, a range of one half hour to 24 hours is preferred for purging with 4 hours between purges being best suited for most emulsified feed polymer systems. During purging, air control valve 29 opens for the purge duration and then closes. A solenoid valve is a typical example of air control valve 29.

Although the system 10 is illustrated with positive pressurized air 72, as an alternative to pressurized air 72, a vacuum may be used to accomplish the purging and removal of material from the polymer/water contact site, the eductor 26 and subsequent conduits. In this example the air supply source is a vacuum instead of a source of pressurized air 72 and the direction of the arrows for air 72 would be reversed.

As illustrated in FIG. 1, valve 20 controls the flow of electrolyte, and valve 15 in conjunction with polymer pump 28 is utilized to provide a desired or pre-determined concentration of polymer in water. This concentration will depend on the desired effective activation and the desired viscosity of the solution. The viscosity should be suitable for handling and will depend on the type of polymer and its intended use. Typically, the concentration of activated polymer 60 is in the range of 0.01% to 15%, 0.2% to 2%.

Figure 3:
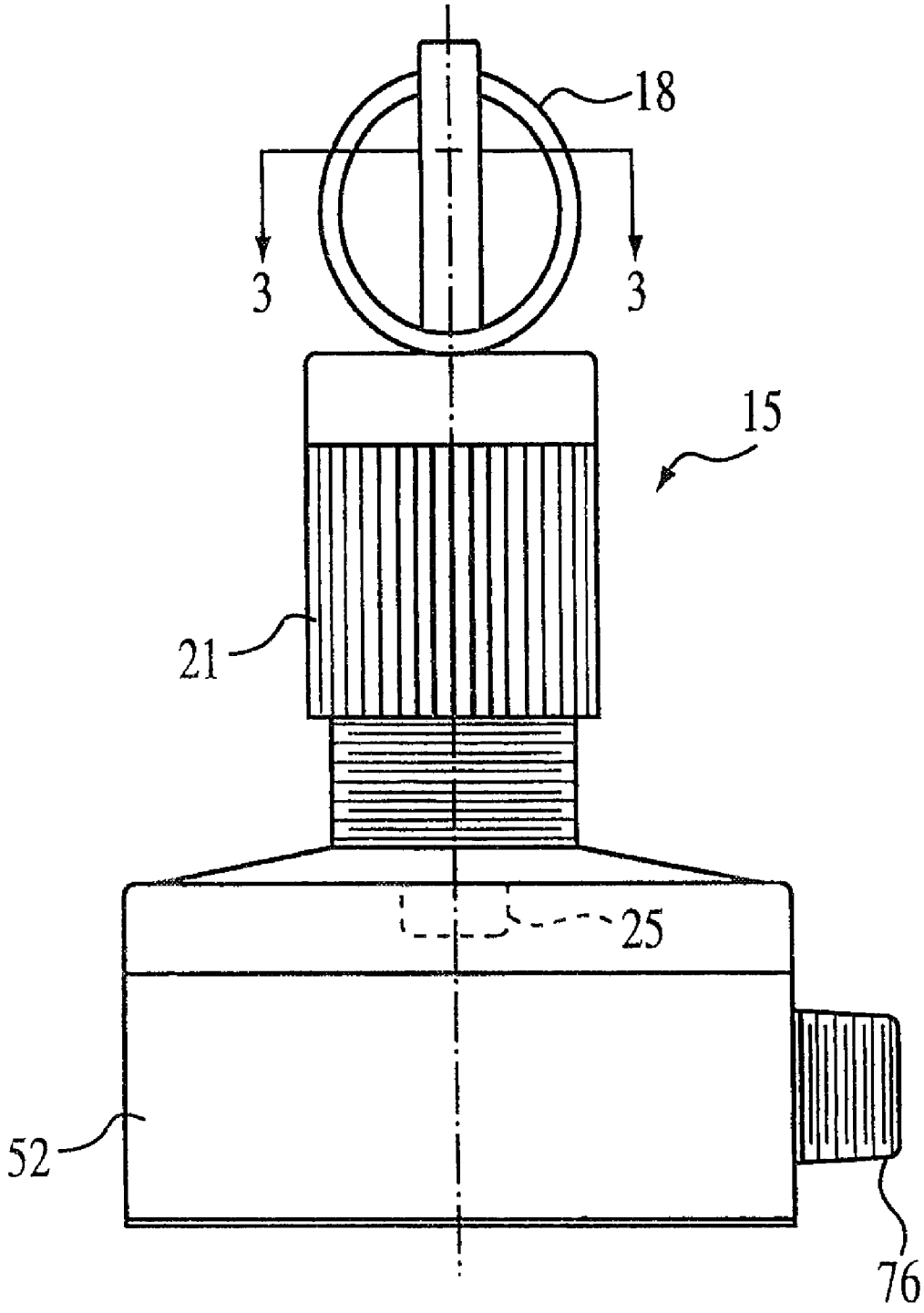
FIG. 3 is a perspective view of a valve assembly to be inserted between the polymer supply line and the mixing chamber.
Figure 4:
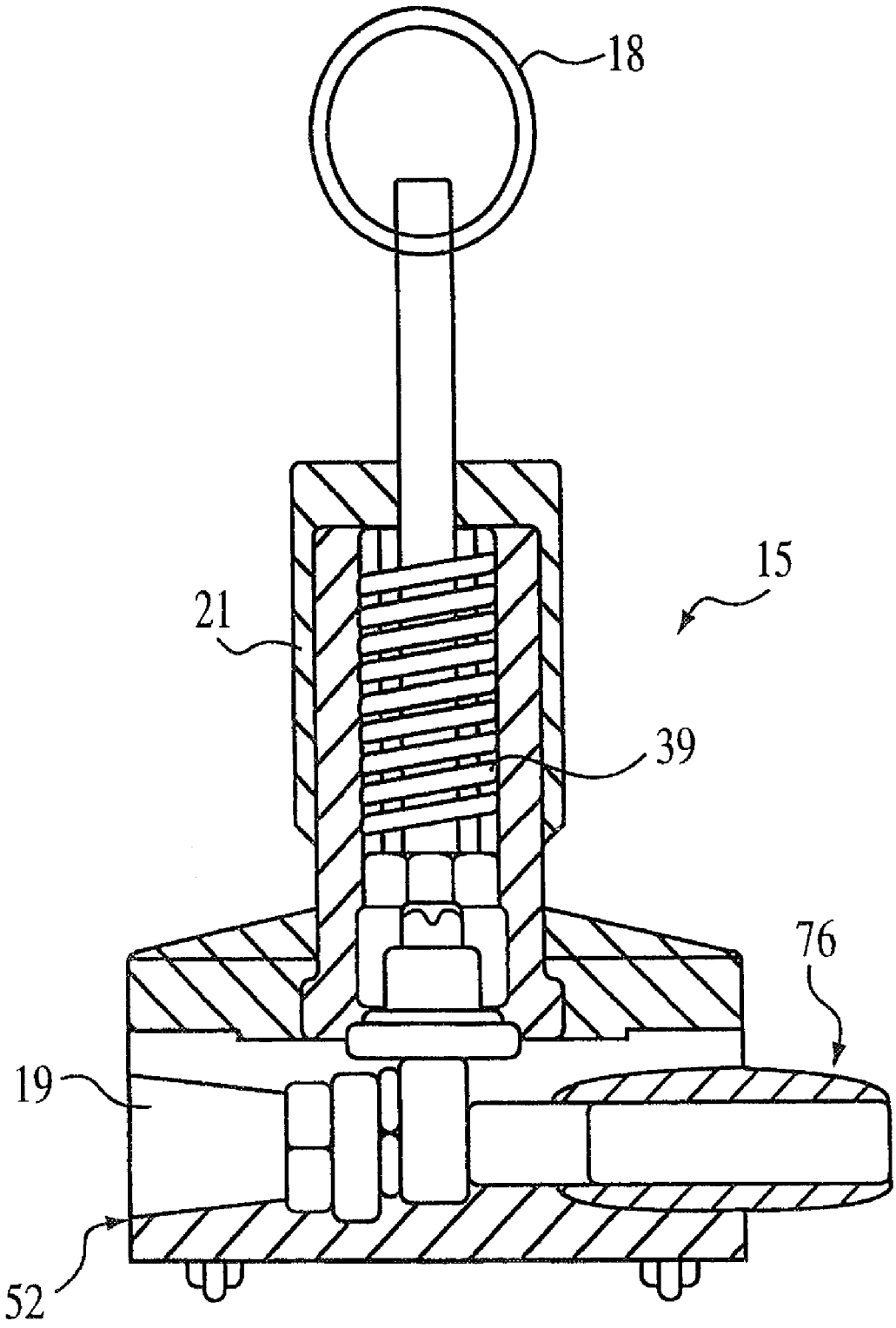
FIG. 4 is a cross-sectional view of the valve assembly in FIG. 3 with the rod ring in an upward position.

Valve assembly 15 illustrated in FIG. 3 and is optional but may be used to control the flow of the polymer 62. It can be seen from FIG. 4 that the cross-sectional area of the conduit 19 is substantially maintained throughout valve assembly 15. If valve assembly 15 is a check valve, it serves as an automatic means to prevent water from gong back towards the polymer supply source. Typical check valves include spring loaded poppet check valves (e.g. available from Parker Hannifin Corporation) or a diaphragm valve (back-pressure valve from Walchem) types. Many types of check valves are suitable for this purpose. Polymer valve assembly 15 may be threaded at the end to threadingly engage the input port 44 or the fitting 13 of the mixing chamber 26. Valve assembly 15 includes a rod ring 18 and a spring assembly 39 which is adjusted via adjustment nut 21. Spring assembly 39 functions to pinch off the flow of the unactivated emulsified polymer 62 and to prevent any backflow. Witness tab 25 provides a visual indicator of the positioning of the valve 15. The cross-sectional view of the valve assembly 15 of FIG. 4 illustrates a substantially equivalent cross-section. The female portion 52 has an inner diameter of approximately ½" and male portion 76 has an outer diameter of ½". If valve assembly 15 were absent, this would correspond to polymer input line 23 having an external diameter of approximately ½". Accordingly, the internal diameter of the polymer input line 23 and the internal diameter of the conduit 19 are substantially equivalent, to avoid funneling of the emulsified polymer.

The polymer input line 23 may be connected directly to the mixing chamber 26 (FIG. 2) or through fitting 13 as illustrated in FIG. 1. Alternatively,' polymer input line 23 may be inserted into valve assembly 15 either by frictional engagement threading engagement. As can be clearly seen in the figures, it is possible to insert either the polymer line 23 or a conduit extending from the valve assembly 15 into mixing chamber 26.

Figure 2:
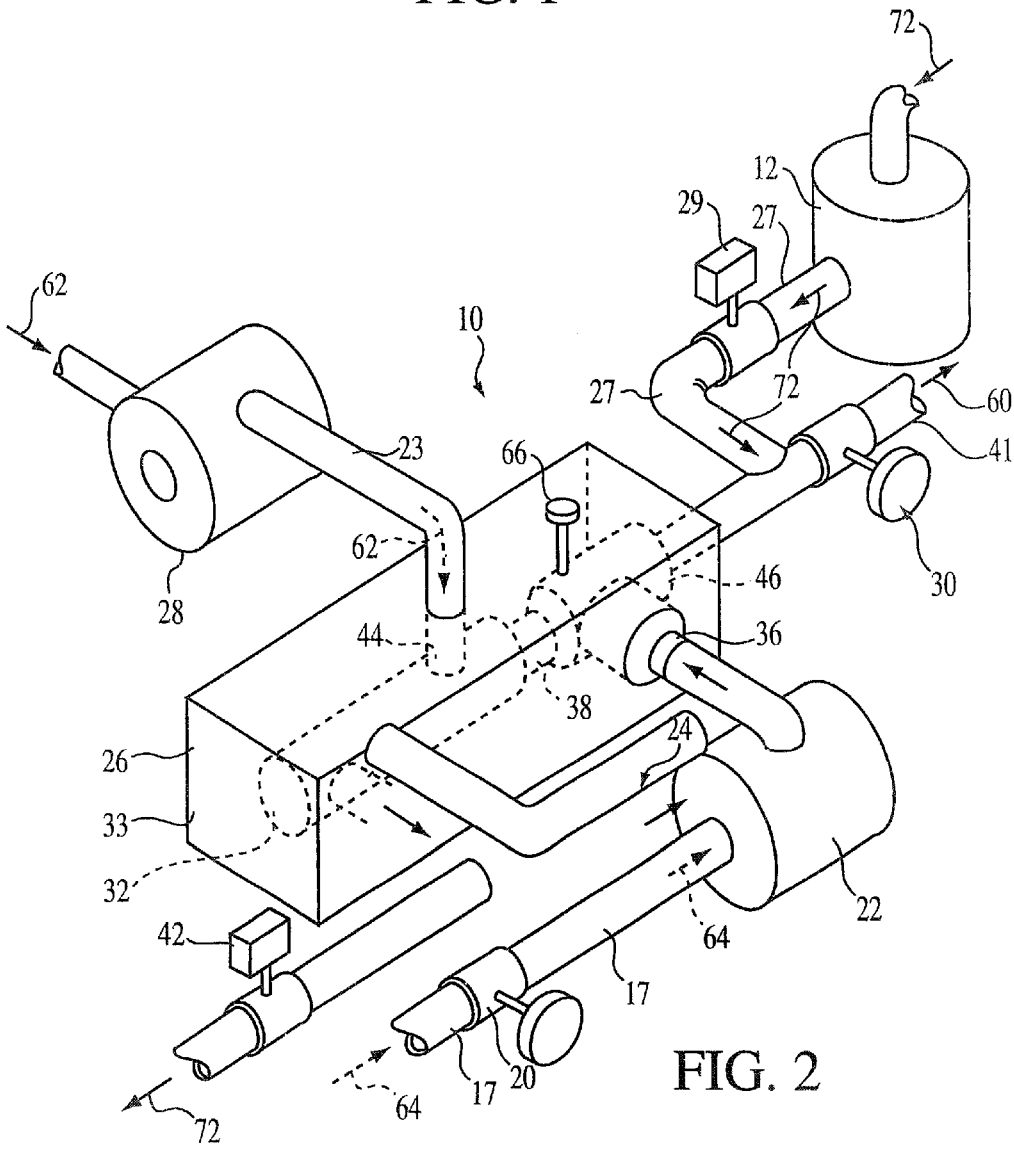
FIG. 2 is a perspective view of an alternative embodiment of the present invention that includes a mixing chamber and a recycling loop.

Mixing chamber 26 illustrated in FIG. 2 is, for example, a solid block of metal having a central bore 32 extending through substantially its entire length. The bore 32 stops short of end 33 and output opening 34. An orifice 38 of fixed diameter is formed near the center of the bulkhead 36 to establish communication between the water inlet hole 36 and the central bore 32, with a flow rate that may be controlled by the orifice diameter.

An orifice 44 is in the mixing chamber 26 to establish communication between polymer supply line 23 and central bore 32. Output port 46 is in direct and fluid communication with the central bore 32 to give an unimpeded outflow of a mixture of polymer and water.

An optional element to the emulsion feed assembly is the addition of a recycle pump 22 and a recycle mixing loop 24 as shown in FIG. 2. This recirculation loop 24 adds additional energy to activate the polymer. In order to have the materials flow in the direction shown, it is necessary to create fluid pressure to force the water and polymer through the mixing chamber and then back to the pump 22. In FIG. 2, there is a recirculation 24 going into the mixing chamber. A portion of the activated polymer 60 goes to dispensing line 41. The remaining portion by means of the orifice size and back pressure regulated by a valve 30, the quantity of recirculation is determined. The recirculation portion continues through a channel. FIG. 2 shows the preferred arrangement of the air purging system where two solenoid valves, air inlet valve 29, and air outlet valve 42 are used. Other arrangements of air purging direction are possible and should involve at least one solenoid valve, but can include more than two solenoid valves to purge any subsequent conduits. Check valves can be used also to prevent the purging from going certain locations. Thus a combination of check valves and solenoid valves can be used to direct the pressurized air 72 or vacuum 72 to both the polymer supply line 23 and mixing chamber 26.

FIG. 1 illustrates the use of an eductor as the mixing chamber 26. Eductor 26 is designed to increase the velocity of the water 64 at its most narrow internal dimension. High water velocity aides in the initial activation of the polymer. FIG. 1 shows a typical arrangement of the polymer input line 23 which goes though a valve 15 or fitting 13, and continues into the eductor mixing chamber 26. By using a polymer input line 23 which is similar in diameter as the eductor 26 most narrow internal dimension, the area of the polymer/water contact site is minimized. Typical dimensions for the polymer supply line 23 in this embodiment is ⅛" internal diameter. A typical diameter for bore 32 is ⅜ inches. While the typical internal diameter of polymer input line 23 is ⅛ inch. Therefore it may be necessary to insert polymer input line 23 through fitting 14. Typical diameter of the orifice 38 is 3/32 inch. These dimensions can vary depending on the polymer properties.

Input valve 20 controls the amount of water supplied to the mixing chamber 26. Water 64 and polymer 62 first meet in the mixing manifold 26, the flow of the water 64 being indicated in FIG. 1 by solid lines and the flow of the polymer 62 being indicated by dashed lines. Valve 20 may be set to provide a predetermined ratio of water 64 to polymer 62. Associated with valve 20 may be a meter (not shown) which is calibrated in gallons per minute. By an adjustment of the water valve 20, one can select the desired output concentration of the system, and the degree of concentration of the resulting inverted polymer solution.

In a typical operation cycle, water is introduced through the centrifugal pump 22 and into the mixing loop 24, the flow of water is controlled and metered by the throttling of flow valve 20.

Mixed water and polymer solution 60 is recycled, via loop 24, through the mixing chamber 26 and the recycle pump 22 (for example a centrifugal pump) which continues to boost the level of the activation or inversion of the polymer.

The emulsion feed system 10 takes in polymer 62 at inlet 62 and water at inlet 64. The throttling valve 20 is set to regulate the amount of water 64 flowing in and, therefore, the ratio of water to polymer. By adjusting valve 20 a more highly concentrated polymer solution may be produced. For example, a solution which is 1% polymer may be increased to a solution which is 2% polymer by a suitable adjustment of valve 20.

As an important component of the emulsion feed system 10, an air purge system 12 may be provided. The air purge line is in fluid communication with the mixing chamber 26 and is comprised of a pressurized air supply source 12 and an air inlet line 27. The air inlet line extends through a air control valve 29 which can be used to regulate the amount of pressurized air 72 entering the system. The emulsified polymer 62 enters into the polymer pump 28 and is pumped through a polymer input line 23 into the mixing chamber 26. The emulsified polymer 62 and the water 64 are mixed in the mixing chamber 26 and may be recycled through recycle loop 24 back into the mixing chamber 26 for more thorough activation and concentration and/or dilution of the polymer/water mixture 60. In FIG. 2, a switching valve 66 may be used to divert the polymer/water mixture 60 back into the centrifugal pump 22 and through the mixing chamber 26 or alternatively switching the flow to dispense the polymer/water mixture 60 at the predetermined concentration. FIG. 1 illustrates input line 23 protruding into mixing chamber 26 to facilitate cleaning of the end input line 23 by the air purge.

An orifice 44 is in the mixing chamber 26 to establish communication between polymer inlet line 23 and the central bore 32. This orifice 44 has a diameter that is substantially equivalent to the diameter of the polymer input line 23. More specifically, the conduit formed which extends from the polymer inlet line 23 and/or through the valve assembly 15 has an internal diameter or cross-sectional area which is substantially equivalent to the diameter or cross-sectional areas of the orifice 44 thereby avoiding funneling of the emulsified polymer 62 which may cause clogging at the orifice 44. The output port 46 is in direct communication with the central bore 32 to give an unimpeded outflow of the polymer/water mixture. The unimpeded outflow of the mixture 60 is then either partially or wholly diverted back into the mixing chamber 26 for further mixing via recycle loop 24. The orifice 44 is adapted to receive the polymer input line 23 of the valve assembly 15. Additionally, the input line 23 or conduit of the valve assembly 15 may be designed to extend into the bore 32 of the mixing chamber 26 in order to be in contact with the flow of water 64 provided via valve 20 and centrifugal pump 22. Allowing the input line polymer inlet line 23 to extend into the mixing chamber allows any partially activated or polymerized polymer which may have precipitated on, or in, the input line 23 or valve assembly 15 to be washed away.

As stated above, pressurized air 72 may be introduced into the mixing chamber to purge any unwanted or partially activated particulate polymer as well as any unwanted moisture. The direction of the pressurized air 72 may be reversed in order to create a vacuum and to displace and moisture in the mixing chamber 26. This is especially useful if done immediately after operation ("shut down") and before any extended rest periods of the polymer activation system 10. Generally, the emulsion feed system 10 of the present invention can be used to create a flow of electrolyte or water 64 in the mixing chamber 26. The flow of water 64 enters into the mixing chamber through orifice 36 into the bore 32. The desired flow rate of the water can be controlled utilizing the pump 22, the control valve 20, the recycling loop 24 and a pressure regulating valve 30. As well as alternating the diameter of orifice 36. After the desired flow of water 64 is achieved in the mixing chamber 26, a polymer 62 from a polymer source is introduced in the polymer supply line 23 via polymer pump 28. The polymer supply line 23 may extend through or stop at valve assembly 15 but is in fluid communication with the central bore 32. It is important when injecting the polymer 62 into the mixing chamber 26 that the orifice 44 and the input line 23 the conduit extending from the valve assembly 15 have a substantially equivalent diameter to avoid funneling of the polymer which may lead to clogging of the polymer supply line 23 and result in unwanted down time of the polymer activation system 16. Upon mixing or activation to the desired level either directly from the mixing chamber 26 or through the recycle loop 24, the activated polymer is dispensed via valve assembly 30 to the desired source.

Although, the examples given are for emulsion polymers, the same application can be applied to dry and solution polymers. Additionally, although, we have been giving examples of polymers that dissolves in water, there are applications, although less common, where polymers are dissolved in hydrocarbons. In these situations the electrolyte is an organic or hydrocarbon based solvent.

It should be evident that this disclosure is by way of example, and that various changes may be made by adding, modifying or eliminating details without departing from the fair scope of the teaching contained in this disclosure. The invention therefore is not limited to particular details of this disclosure except to the extent that the following claims are necessarily so limited.

What is claimed is:

1. A method of mixing a polymer with an electrolyte comprising:

dispensing electrolyte in a mixing chamber; and injecting a polymer from a polymer supply line into a flow of electrolyte through an input port in said mixing chamber, said supply line and said input port having substantially equivalent cross-sectional areas.

2. The method of claim 1, further comprising purging said mixing chamber of any excess polymer/electrolyte mixture with pressurized air.

3. The method of claim 1, further comprising the step of creating a vacuum in said mixing chamber to remove excess moisture.

4. The method of claim 1, wherein a valve assembly is inserted between said polymer supply line and said input port.

5. The method of claim 1, wherein said valve assembly extends through said input port into said mixing chamber and is in contact with said electrolyte, whereby any excess polymer is removed from said valve assembly by the flow of electrolyte.

6. The method of claim 5, wherein said polymer is an emulsified polymer.

7. A method of producing activated polymer, comprising:

injecting a stream of water into a mixing chamber;

injecting an inactive polymer into said stream of water to thereby activate said polymer;

dispensing said activated polymer; and purging said mixing chamber of any excess polymer or electrolyte by injecting pressurized air.

8. The method of claim 7, wherein said inactive polymer is injected through a substantially uniform diameter polymer supply line.

9. The method of claim 8, wherein a tip of said polymer supply line extends into said stream of water, whereby said tip is cleaned by the flow of water.

10. The method of claim 8, wherein said inactive polymer is encased in an oil.

* * * * *